US007548720B2

(12) United States Patent
Hari

(10) Patent No.: US 7,548,720 B2
(45) Date of Patent: Jun. 16, 2009

(54) IMAGE READING APPARATUS CAPABLE OF READING AN IMAGE WITH IMPROVED ACCURACY

(75) Inventor: Kenji Hari, Nagoya (JP)

(73) Assignee: Ricoh Company, Ltd., Tokyo (JP)

( * ) Notice: Subject to any disclaimer, the term of this patent is extended or adjusted under 35 U.S.C. 154(b) by 373 days.

(21) Appl. No.: 11/369,913

(22) Filed: Mar. 8, 2006

(65) Prior Publication Data

US 2006/0204298 A1 Sep. 14, 2006

(30) Foreign Application Priority Data

Mar. 9, 2005 (JP) ..... 2005-065590
Dec. 14, 2005 (JP) ..... 2005-360430

(51) Int. Cl.
*G03G 15/00* (2006.01)

(52) U.S. Cl. ..... 399/367; 399/373; 399/374

(58) Field of Classification Search ..... 399/367
See application file for complete search history.

(56) References Cited

U.S. PATENT DOCUMENTS 6,877,742 B2 * 4/2005 Nishikata et al. ..... 271/264

FOREIGN PATENT DOCUMENTS

JP 2003087510 A * 3/2003
JP 2004-129308 4/2004

* cited by examiner

*Primary Examiner*—Daniel J Colilla
*Assistant Examiner*—Allister Primo
(74) *Attorney, Agent, or Firm*—Oblon, Spivak, McClelland, Maier & Neustadt, P.C.

(57) ABSTRACT

An image reading apparatus includes a body and an auto document feeder. The body includes an exposure glass, a reader for reading an image of an original sheet through the exposure glass, and a guide disposed on the exposure glass and configured to support the original sheet. The auto document feeder is swingably moved between an open position and a closed position relative to the body and feeds the original sheet onto the exposure glass when situated at the closed position. The auto document feeder includes a press and a regulator. The press presses the original sheet onto the exposure glass. The regulator is mounted to the press and contacts the guide when the auto document feeder is situated at the closed position so as to form a slit between the exposure glass and the press. The slit is barely enough to allow the original sheet to pass therethrough.

13 Claims, 17 Drawing Sheets

IMAGE READING APPARATUS CAPABLE OF READING AN IMAGE WITH IMPROVED ACCURACY

CROSS-REFERENCE TO RELATED APPLICATIONS

The present application is based on and claims priority to Japanese patent applications No. 2005-065590 filed on Mar. 9, 2005 and No. 2005-360430 filed on Dec. 14, 2005 in the Japan Patent Office, the entire contents of each of which are hereby incorporated herein by reference.

BACKGROUND OF THE INVENTION

1. Field of the Invention

The present invention relates to an image reading apparatus for reading an image of a document, and more particularly to an image reading apparatus having an auto document feeder.

2. Description of the Background Art

Reading images is a process employed by various kinds of apparatuses such as image scanners, copying machines, facsimile machines, and so forth, which handle image data of a document. This process of image reading is generally performed by an image reading apparatus.

A background image reading apparatus includes an image reading unit for reading images and an auto document feeder which feeds a document to the image reading unit one sheet at a time from a number of sheets stacked. The auto document feeder is swingably mounted to an upper surface of the image reading unit to form a clamshell-like shape. With this configuration, the auto document feeder is allowed to be both lifted to an open position and lowered to a closed position.

When the auto document feeder is at the open position, it provides an access area to a book exposure glass of the image reading unit on which a document including a book document can be placed manually by an operator. In this operation, the auto document feeder is inoperable. When the auto document feeder is then closed down on the book exposure glass, it holds a document placed at a book reading position on the book exposure glass so that a book reading may be started.

On the other hand, a sheet reading using the auto document feeder may be ready to start when the auto document feeder is located at the closed position. In this operation, sheets to be read are stacked in the auto document feeder and are consecutively fed one after another to a sheet reading position on a sheet exposure glass of the image reading unit by the auto document feeder.

In the sheet reading, a sheet to be read is transported to pass through a gap of the sheet reading position formed between the sheet exposure glass and a bottom surface of the auto document feeder situated at the closed position. This gap of the sheet reading position needs to be accurately formed to perform an accurate image reading.

SUMMARY OF THE INVENTION

This specification describes a novel image reading apparatus. In one aspect of the present invention, the novel image reading apparatus includes a body and an auto document feeder. The body includes an exposure glass, a reader, and a guide. The reader is configured to read an image of an original sheet through the exposure glass. The guide is disposed on the exposure glass and is configured to support the original sheet.

The auto document feeder is swingably moved between an open position and a closed position relative to the body and is configured to feed the original sheet onto the exposure glass when situated at the closed position. The auto document feeder includes a press and a regulator. The press is configured to press the original sheet onto the exposure glass. The regulator is mounted to the press and is configured to contact the guide when the auto document feeder is situated at the closed position so as to form a slit between the exposure glass and the press. The slit is barely enough to allow the original sheet to pass therethrough.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
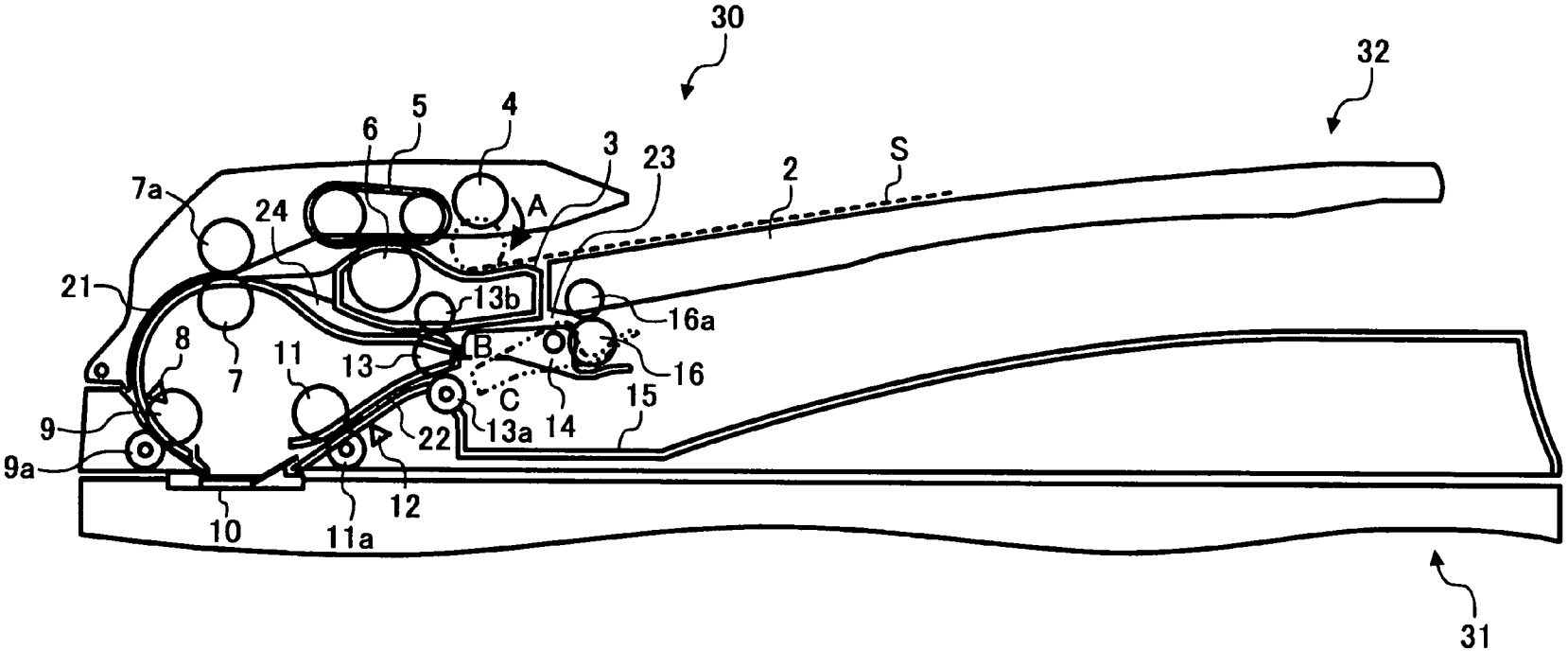
FIG. 1 is a cross-sectional view of an image reading apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image reading apparatus according to an exemplary embodiment of the present invention is explained.

As illustrated in FIG. 1, an image reading apparatus 30 includes a body 31 and an auto document feeder 32. The image reading apparatus 30 performs a process of image reading, which is employed by an image scanner, a copying machine, a facsimile machine, or the like. The auto document feeder 32 is configured to feed an original sheet S to the body 31. The body 31 is configured to read an image on the original sheet S.

The body 31 includes a reader 10. The reader 10 is configured to read an image on the original sheet S.

The auto document feeder 32 includes an input table 2, a guide board 3, a roller 4, a feeder 5, a separator 6, a first conveyance path 21 including a conveying roller 7, a driven roller 7*a*, an entrance roller 9, and a driven roller 9*a*, a registration sensor 8, a second conveyance path 22 including an exit roller 11, a driven roller 11*a*, an output roller 13, and a lower driven roller 13*a*, an output sensor 12, a switching member 14, an output tray 15, a third conveyance path 23 including a reverse roller 16 and a driven roller 16*a*, and a fourth conveyance path 24 including an upper driven roller 13*b*.

The input table 2 is configured to have original sheets S having images to be read placed thereon. The guide board 3 is configured to position the original sheets S. The roller 4 is configured to press the original sheets S onto the guide board 3 and feed the original sheets S toward the feeder 5 and the separator 6. The feeder 5 and the separator 6 are configured to separate the original sheets S one by one and send each original sheet S toward the first conveyance path 21. The first conveyance path 21 is configured to convey the original sheet S toward the second conveyance path 22 via the reader 10 of the body 31. The conveying roller 7, the driven roller 7*a*, the entrance roller 9, and the driven roller 9*a* are disposed along the first conveyance path 21 and are configured to feed the original sheet S toward the second conveyance path 22 via the reader 10. The registration sensor 8 is configured to detect a lead edge of the original sheet S conveyed.

The second conveyance path 22 is configured to convey the original sheet S fed from the first conveyance path 21 toward the output tray 15 or the third conveyance path 23. The exit roller 11, the driven roller 11*a*, the output roller 13, and the lower driven roller 13*a* are disposed along the second conveyance path 22 and are configured to feed the original sheet S toward the output tray 15 or the third conveyance path 23. The output sensor 12 is configured to detect the lead edge of the original sheet S conveyed.

The switching member 14 is configured to move to lead the original sheet S conveyed from the second conveyance path 22 to the output tray 15 or the third conveyance path 23. The output tray 15 is configured to receive the original sheet S fed from the second conveyance path 22. The third conveyance path 23 is configured to convey the original sheet S fed from the second conveyance path 22 toward the fourth conveyance path 24. The reverse roller 16 and the driven roller 16*a* are disposed along the third conveyance path 23 and are configured to feed the original sheet S toward the output roller 13 and the upper driven roller 13*b*. The upper driven roller 13*b* is configured to feed the original sheet S toward the fourth conveyance path 24. The fourth conveyance path 24 is configured to convey the original sheet S fed by the upper driven roller 13*b* to the first conveyance path 21.

Original sheets S are placed on the input table 2 with a front side image of each of the original sheets S facing up. An uppermost original sheet S is fed one by one in accordance with a signal output by the body 31 and is conveyed through the first conveyance path 21 to the reader 10.

Specifically, lead edges of the original sheets S are properly positioned by contacting the guide board 3. A solenoid (not shown) lowers the roller 4 in a direction A in accordance with a start signal output by the body 31 so that the roller 4 presses the original sheets S onto the guide board 3.

The feeder 5 and the separator 6 separate the uppermost original sheet S from the other original sheets S and feed the uppermost original sheet S.

The lowered roller 4 is lifted when a predetermined time period elapses after the feeding starts or when the registration sensor 8 detects a lead edge of the original sheet S. The lifted roller 4 releases a pressure applied onto the original sheet S placed between the roller 4 and the guide board 3, shortening a time period when a back side image on the conveyed original sheet S scrubs a front side image on a following original sheet S.

A shortest possible time period is preferably set for the predetermined time period elapsing after the feeding starts. If the original sheet S has a front side image and does not have a back side image, the roller 4 may not be lifted. An operator can select whether to read an image on one side or both sides of the original sheet S.

The separated original sheet S is conveyed through the first conveyance path 21. The registration sensor 8 detects the lead edge of the original sheet S so that image reading starts at a proper timing when the lead edge of the original sheet S passes the reader 10. If the lead edge of the original sheet S does not reach the registration sensor 8 when a predetermined time period elapses after the feeding starts, the image reading apparatus 30 recognizes that the original sheet S is jammed.

When only the front side image on the original sheet S is to be read, the original sheet S is conveyed onto the output tray 15 after the reader 10 reads the image on the original sheet S. If the lead edge of the original sheet S does not reach the output sensor 12 or a tail edge of the original sheet S does not pass the output sensor 12 when a predetermined time period elapses after the image is read, the image reading apparatus 30 recognizes that the original sheet S is jammed.

The switching member 14 is usually positioned at a position B. When both the front side image and the back side image are to be read, the original sheet S is conveyed through the second conveyance path 22 after the reader 10 reads the front side image on the original sheet S. When the output sensor 12 detects the lead edge of the original sheet S or when a predetermined time period elapses after the registration sensor 8 detects the lead edge of the original sheet S, a solenoid (not shown) lowers the switching member 14 to a position C to convey the original sheet S toward the third conveyance path 23. When a predetermined time period (i.e., a time period required for the tail edge of the original sheet S to pass the output roller 13 and reach the switching member 14) elapses after the tail edge of the original sheet S passes the output sensor 12, the solenoid is released to return the switching member 14 to the position B.

When the switching member 14 returns to the position B, the reverse roller 16 reverses its rotating direction to feed a lead edge of the original sheet S in a sheet conveyance direction to a nip formed between the output roller 13 and the upper driven roller 13*b*. The output roller 13 stops rotating to correct skew of the original sheet S.

After the skew of the original sheet S is corrected, the original sheet S is conveyed through the fourth conveyance path 24 and the first conveyance path 21 back to the reader 10. The reader 10 then reads the back side image on the original sheet S. If the original sheet S is conveyed through the second conveyance path 22 onto the output tray 15 after the back side image on the original sheet S is read, the original sheet S is placed onto the output tray 15 with the back side image facing down. As a result, pages of the original sheets S are not properly collated. To solve this problem, the switching member 14 lowers to the position C to convey the original sheet S through the second conveyance path 22 and the third conveyance path 23. Then, the switching member 14 returns to the position B to convey the original sheet S through the fourth conveyance path 24, the first conveyance path 21, and the second conveyance path 22 to the output tray 15.

A next original sheet S is fed in accordance with a signal output by the body 31. If the roller 4 is lowered immediately before the feeding starts, an extra time period to lower the roller 4 is required, resulting in decreased productivity. To prevent this, the roller 4 is lowered before the next original sheet S is fed. When the registration sensor 8 detects the lead edge of a previous original sheet S after the original sheet S is conveyed through the fourth conveyance path 24, the roller 4 is lowered. The roller 4 may be lowered at any time from a time when the tail edge of the previous original sheet S passes the roller 4 until the next original sheet S is fed from the input table 2. However, the roller 4 may not be lowered while the reader 10 reads an image on the original sheet S because vibration of the lowering roller 4 may affect the image reading.

Figure 2:
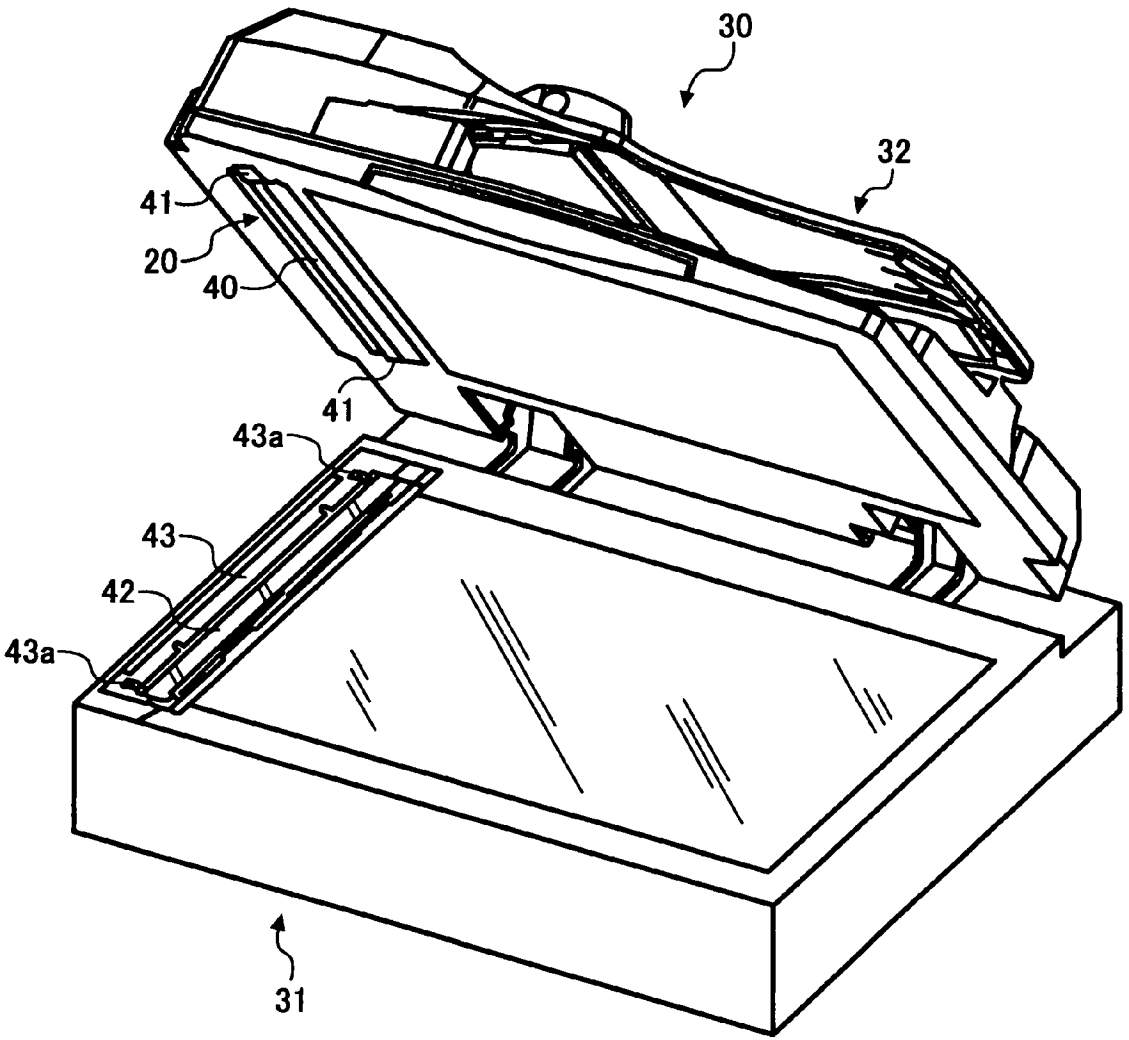
FIG. 2 is a perspective view of the image reading apparatus shown in FIG. 1.

As illustrated in FIG. 2, the auto document feeder 32 further includes a presser 20 including a press 40 and regulators 41. The body 31 further includes an exposure glass 42, and a guide 43 including positioners 43*a*.

The presser 20 is positioned with respect to the guide 43 to press an original sheet S onto the exposure glass 42. The press 40 is configured to press the original sheet S onto the exposure glass 42. The regulators 41 are disposed at both ends of the press 40 in a direction perpendicular to the sheet conveyance direction and are configured to position the press 40 with respect to the guide 43. The exposure glass 42 is configured to form a glass through which an image on the original sheet S is read. The guide 43 is disposed near the reader 10 to surround the exposure glass 42. The positioners 43*a* are disposed at both ends of the guide 43 in the direction perpendicular to the sheet conveyance direction and are configured to position the regulators 41 when the auto document feeder 32 is lowered onto the body 31.

The positioners 43*a* can be integrally molded with the guide 43. However, the positioners 43*a* may be separately molded from the guide 43 and may be attached to the guide 43 with an adhesive. The regulators 41 may be integrally molded with the press 40.

The auto document feeder 32 is swingably moved between an open position and a closed position relative to the body 31. When the auto document feeder 32 is lowered onto the body 31 (i.e., when the auto document feeder 32 is situated at the closed position), the auto document feeder 32 feeds the original sheet S onto the exposure glass 42.

The regulators 41 are mounted to the press 40 and contact the guide 43 when the auto document feeder 32 is situated at the closed position so as to form a slit between the exposure glass 42 and the press 40. The slit is barely enough to allow the original sheet S to pass therethrough.

Figure 3A:
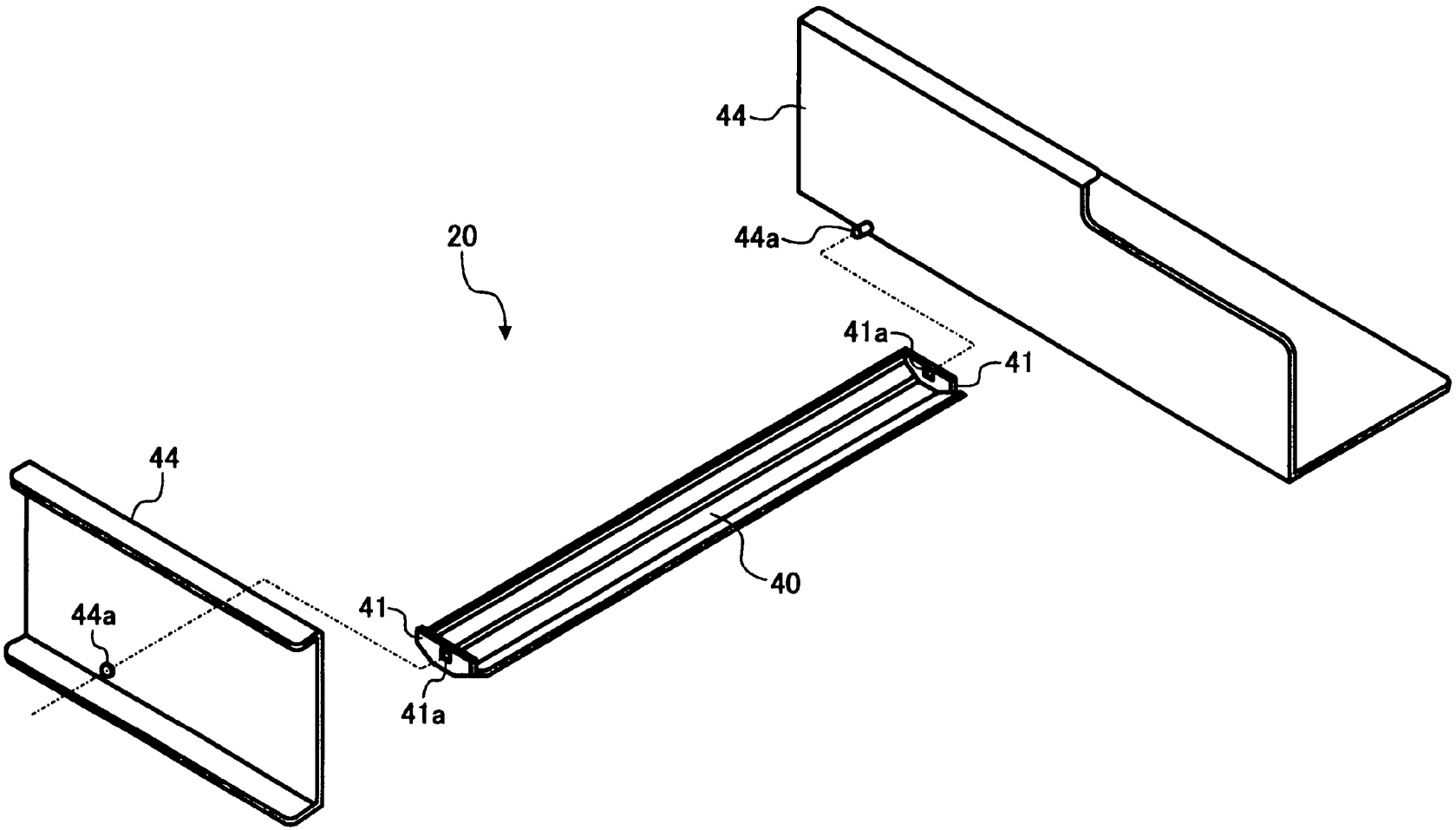
FIG. 3A is a perspective view of a presser of the image reading apparatus shown in FIG. 2.

As illustrated in FIG. 3A, the presser 20 further includes side boards 44. Each of the side boards 44 includes a shaft 44*a*. Each of the regulators 41 includes a hole 41*a*.

The side boards 44 are configured to support the regulators 41 at the both ends of the press 40 in the direction perpendicular to the sheet conveyance direction. Each of the shafts 44*a* protrudes from the side board 44 and is engaged with the hole 41*a* to support the regulator 41. The hole 41*a* is disposed on the regulator 41 and is engaged with the shaft 44*a*. The hole 41*a* is formed larger than a diameter of the shaft 44*a* so that the shaft 44*a* moves in a vertical direction and in the sheet conveyance direction.

Figure 3B:
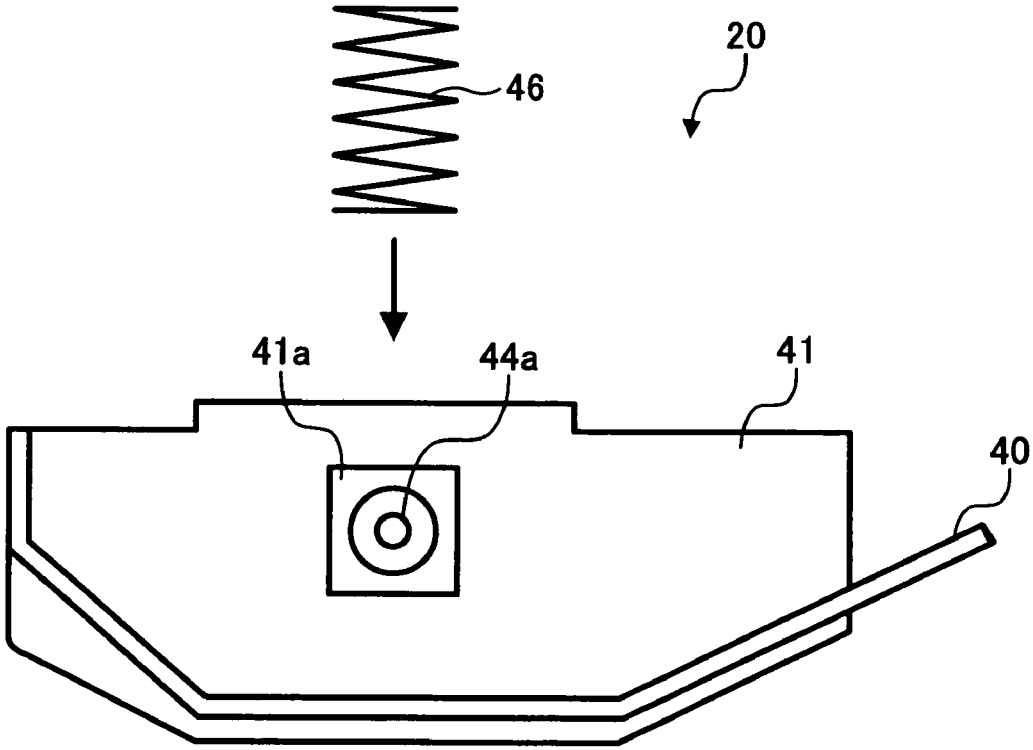
FIG. 3B is a cross-sectional view of the presser shown in FIG. 3A.

As illustrated in FIG. 3B, the presser 20 further includes a spring 46. The spring 46 is configured to apply a pressure downward to the regulator 41. According to this non-limiting embodiment, a coil spring is used as the spring 46. However, a leaf spring or other elastic material may be used.

Figure 4:
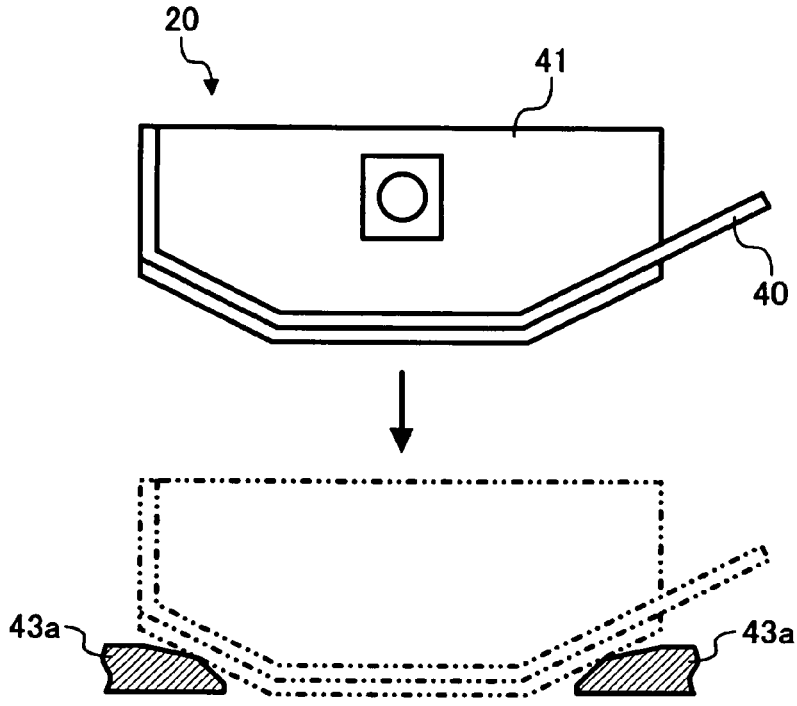
FIG. 4 is a cross-sectional view illustrating positioning of the presser shown in FIG. 3B.
Figure 5:
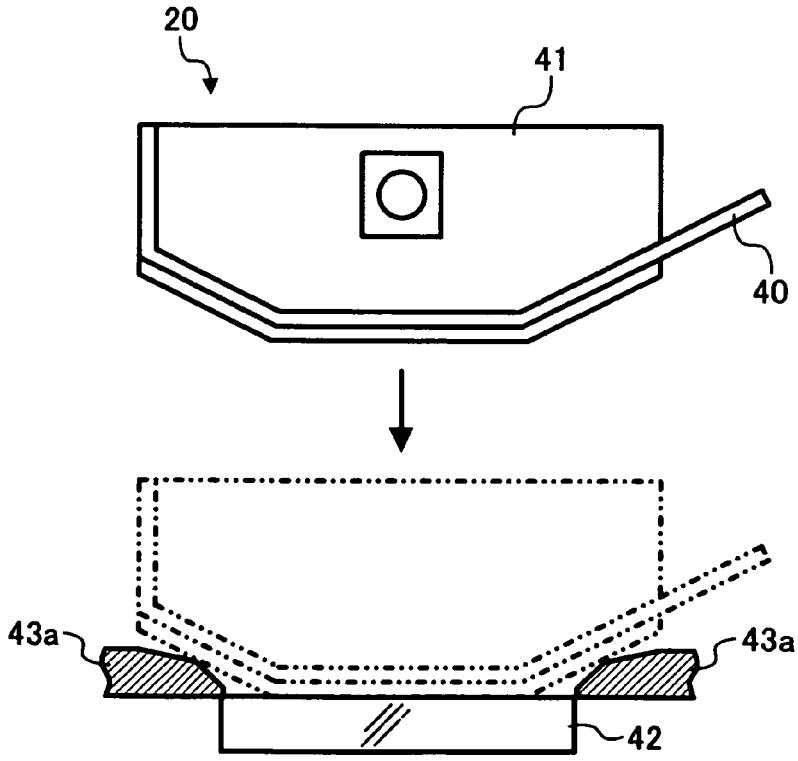
FIG. 5 is a cross-sectional view illustrating another positioning of the presser shown in FIG. 3B.
Figure 6:
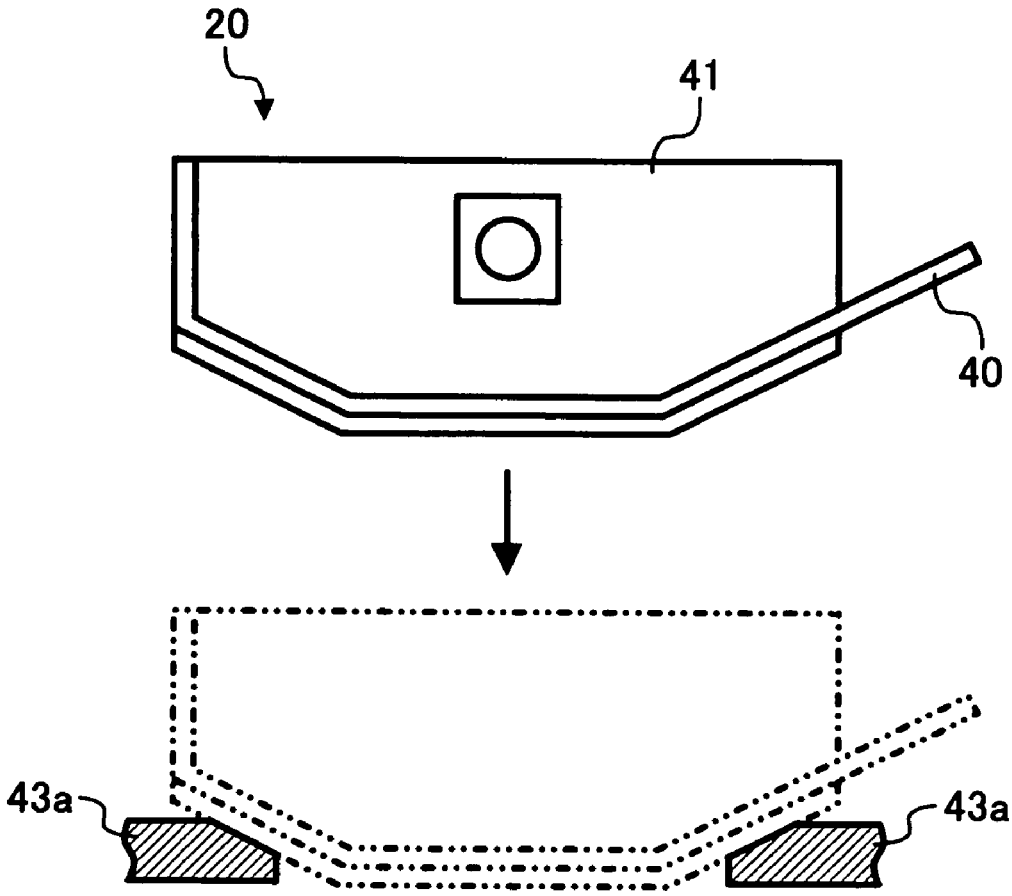
FIG. 6 is a cross-sectional view illustrating yet another positioning of the presser shown in FIG. 3B.

FIGS. 4 to 6 illustrate examples of the regulator 41 of the auto document feeder 32 and the positioners 43*a* of the body 31 according to this non-limiting embodiment of the present invention.

As illustrated in FIG. 4, when the auto document feeder 32 is situated at the closed position, the regulator 41 is positioned in accordance with shapes of the positioners 43*a*. The positioned regulator 41 regulates a clearance between the press 40 and the exposure glass 42.

As illustrated in FIG. 5, when the auto document feeder 32 is situated at the closed position, the regulator 41 is positioned in the sheet conveyance direction in accordance with the shapes of the positioners 43*a*. The regulator 41 is positioned in the vertical direction when a bottom surface of the regulator 41 contacts a top surface of the exposure glass 42. While the bottom surface of the regulator 41 contacts the top surface of the exposure glass 42, the regulator 41 regulates the clearance between the press 40 and the exposure glass 42.

As illustrated in FIG. 6, when the auto document feeder 32 is situated at the closed position, the spring 46 applies the pressure downward to the regulator 41. Concavo-convex shapes of the positioners 43*a* are similar to those of the regulator 41. Thus, the regulator 41 is properly positioned along the positioners 43*a*. The positioned regulator 41 regulates the clearance between the press 40 and the exposure glass 42. Namely, when the auto document feeder 32 is situated at the closed position, surfaces of two slanted portions of the regulator 41 disposed in upstream and downstream ends in the sheet conveyance direction contact surfaces of the two regulators 43*a*.

Figure 7:
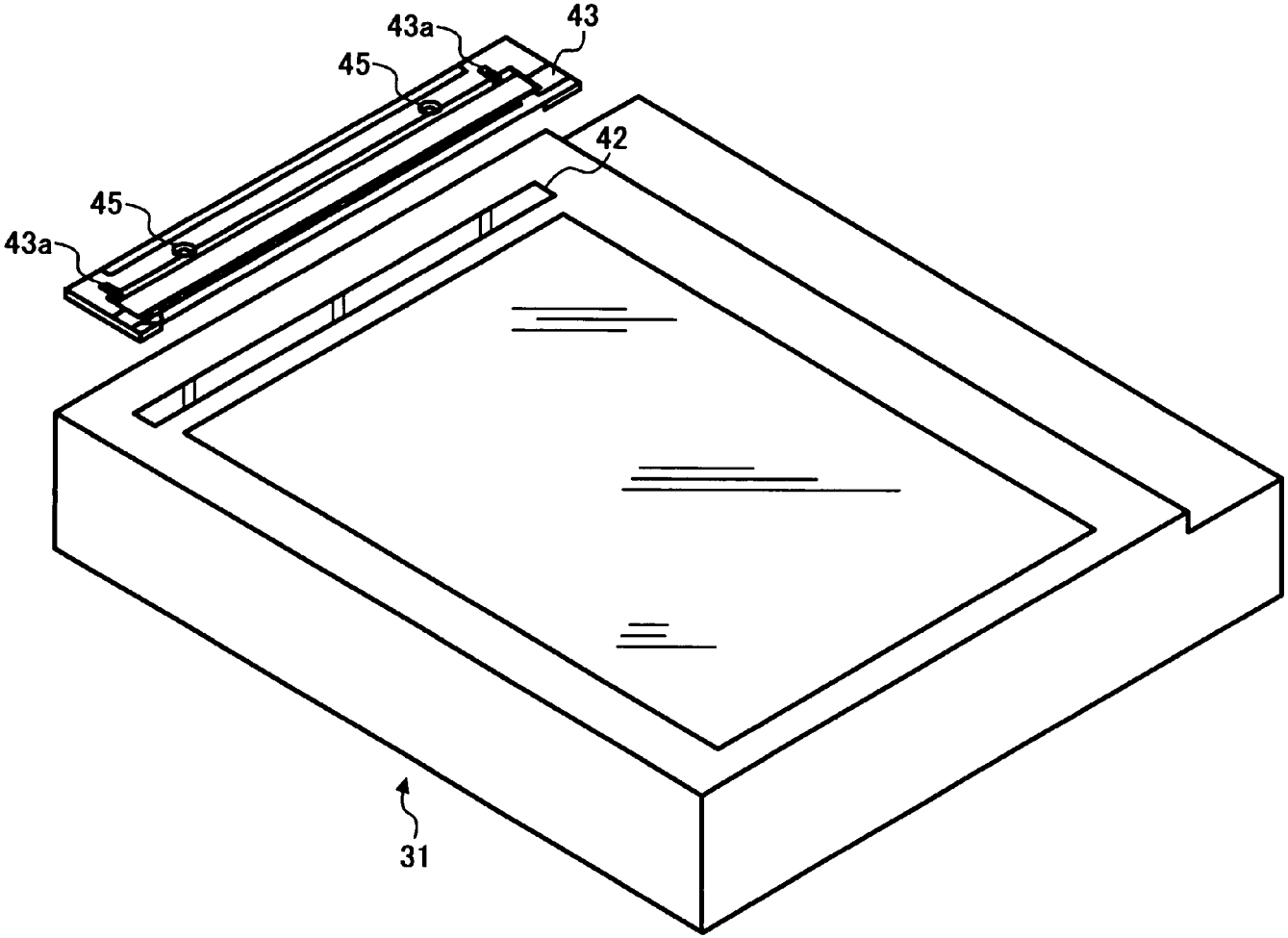
FIG. 7 is a perspective view of a body of the image reading apparatus shown in FIG. 2.

FIG. 7 illustrates an example of the guide 43 according to this non-limiting embodiment of the present invention.

As illustrated in FIG. 7, the guide 43 is attachable and detachable to and from the body 31. The guide 43 further includes screw holes 45. The screw holes 45 are used as fixing members for fixing the guide 43 and the exposure glass 42 to the reader 10 of the body 31. Screws or bolts (not shown) are inserted into the screw holes 45.

According to this non-limiting embodiment, the regulator 41 for positioning the press 40 with respect to the guide 43 is disposed on the press 40, preventing incorrectly sized parts of the image reading apparatus 30 or wobbled hinges for lifting and lowering the auto document feeder 32 from affecting operations of the image reading apparatus 30. As a result, the image reading apparatus 30 can provide improved image reading quality.

According to this non-limiting embodiment, the regulators 41 are integrally molded with the press 40, suppressing susceptibility to errors in attaching the regulators 41 to the press 40. As a result, the image reading apparatus 30 can provide improved image reading quality.

According to this non-limiting embodiment, the bottom surface of the regulator 41 contacts the top surface of the exposure glass 42 to keep the clearance between the press 40 and the exposure glass 42, preventing the image reading apparatus 30 from creating data of an unfocused image or obliquely conveying the original sheet S. As a result, the image reading apparatus 30 can provide improved image reading quality.

According to this non-limiting embodiment, the surfaces of the regulator 41 and the positioners 43*a* contacting each other have a common concavo-convex shape, properly positioning the regulator 41 along the positioners 43*a*. As a result, the image reading apparatus 30 can provide improved image reading quality.

According to this non-limiting embodiment, the spring 46 applies a pressure downward to the regulator 41, preventing the original sheet S passing the reader 10 from pushing up the press 40 and the regulator 41 to cause the regulator 41 to improperly contact the positioners 43*a* or to create an uneven clearance between the press 40 and the exposure glass 42. As a result, the image reading apparatus 30 can provide an improved image reading quality.

According to this non-limiting embodiment, the guide 43 includes the screw holes 45 used as the fixing members for fixing the exposure glass 42 to the body 31. Therefore, no extra part is required to fix the exposure glass 42 to the body 31 and the image reading apparatus 30 can be manufactured at a lower cost.

FIGS. 8 to 12 illustrate the image reading apparatus 30 according to another exemplary embodiment of the present invention. The image reading apparatus 30 according to this non-limiting embodiment includes a presser 20*a* replacing the presser 20 and a guide 53 replacing the guide 43. The other parts of the image reading apparatus 30 according to this non-limiting embodiment are common to the image reading apparatus 30 according to the previous non-limiting embodiment.

Figure 8:
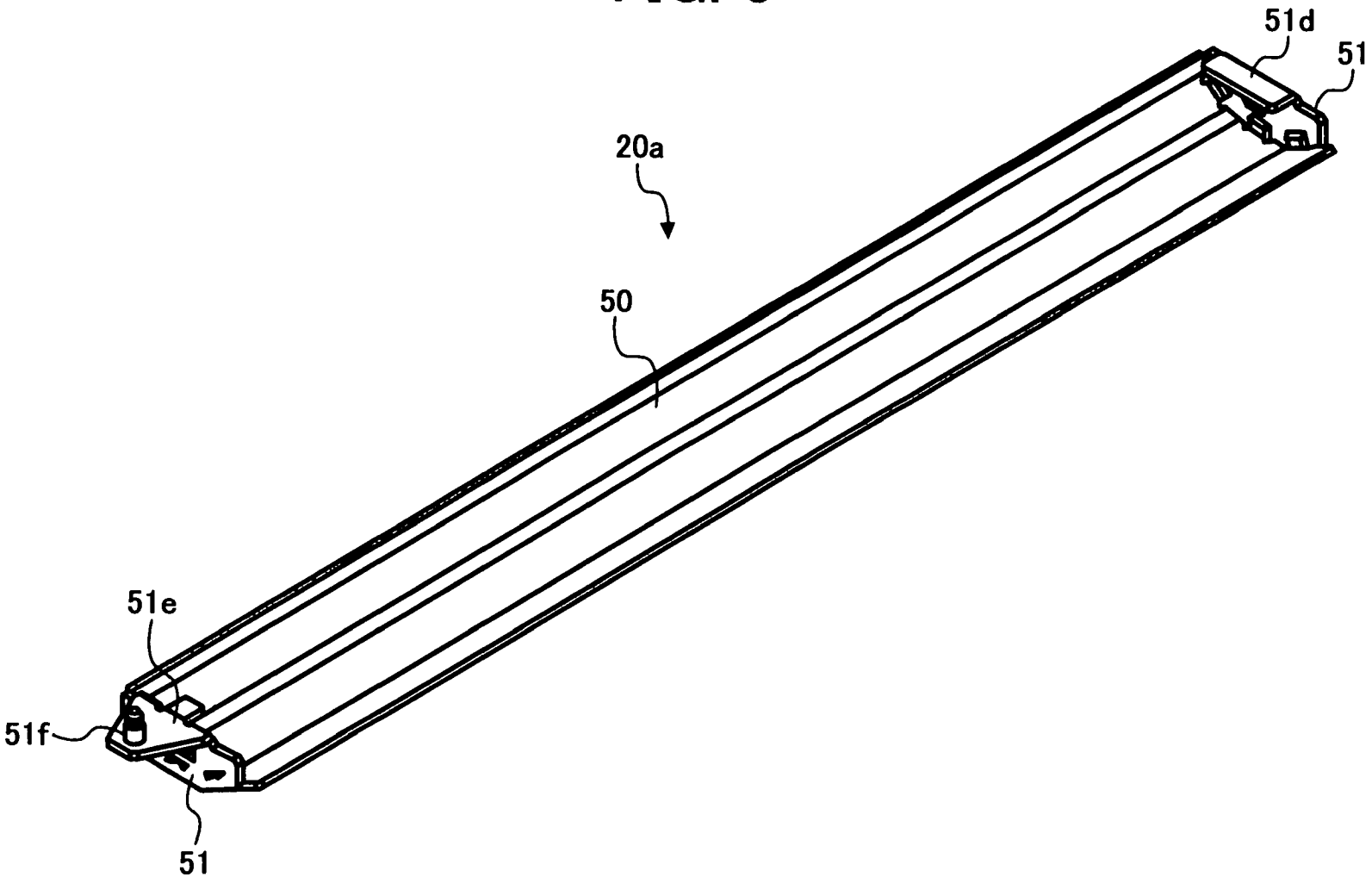
FIG. 8 is a top perspective view of a presser of an image reading apparatus according to another exemplary embodiment of the present invention.
Figure 9:
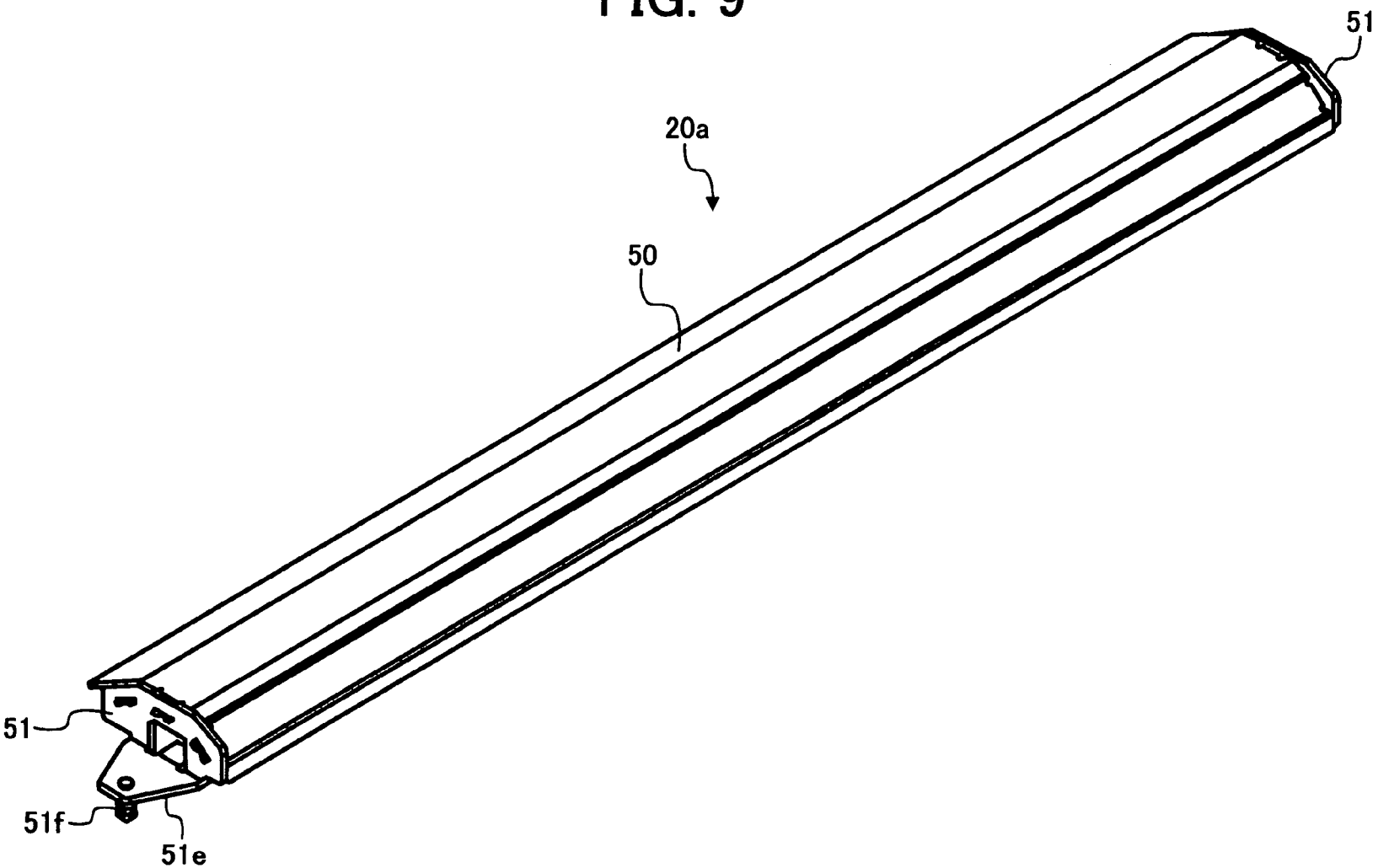
FIG. 9 is a bottom perspective view of the presser shown in FIG. 8.

As illustrated in FIGS. 8 and 9, the presser 20*a* includes a press 50 and regulators 51. The regulators 51 include an attachment 51*d*, a tab 51*e*, and an attachment 51*f*.

The presser 20*a* is positioned with respect to the guide 53 to press an original sheet S onto the exposure glass 42. The press 50 is configured to press the original sheet S onto the exposure glass 42. The regulators 51 are disposed at both ends of the press 50 in the direction perpendicular to the sheet conveyance direction and are configured to position the press 50 with respect to the guide 53. The attachment 51*d* is disposed on one of the regulators 51 and is configured to slide in a horizontal direction to attach the regulator 51 to the auto document feeder 32. The tab 51*e* is disposed on the other regulator 51 and is configured to support the attachment 51*f*. The attachment 51*f* is disposed on the tab 51*e* and is vertically inserted into the auto document feeder 32 via an elastic member such as a spring to attach the regulator 51 to the auto document feeder 32.

Figure 10:
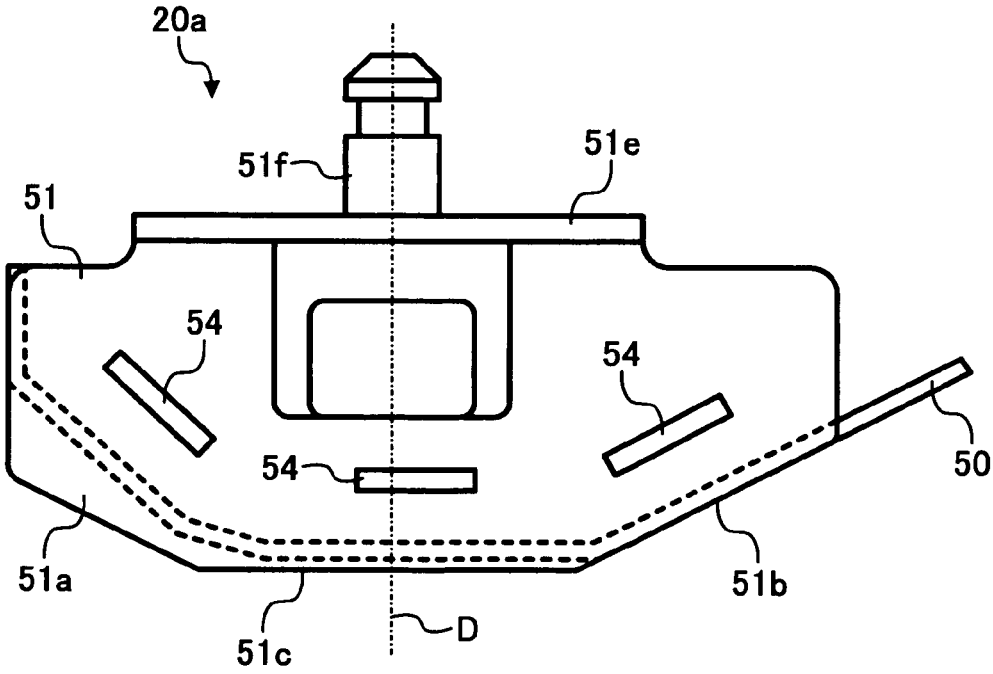
FIG. 10 is a side view of the presser shown in FIG. 8.

As illustrated in FIG. 10, the regulator 51 further includes a horizontal portion 51*c*, an upstream slant 51*a*, a downstream slant 51*b*, and caulking portions 54.

The horizontal portion 51*c* is disposed parallel to the top surface of the exposure glass 42 and a bottom surface of the press 50. The upstream slant 51*a* is disposed upstream (i.e., left) in the sheet conveyance direction. The downstream slant 51*b* is disposed downstream (i.e., right) in the sheet conveyance direction. The caulking portions 54 are positions where the regulator 51 is jointed with the press 50 by caulking.

Figure 11:
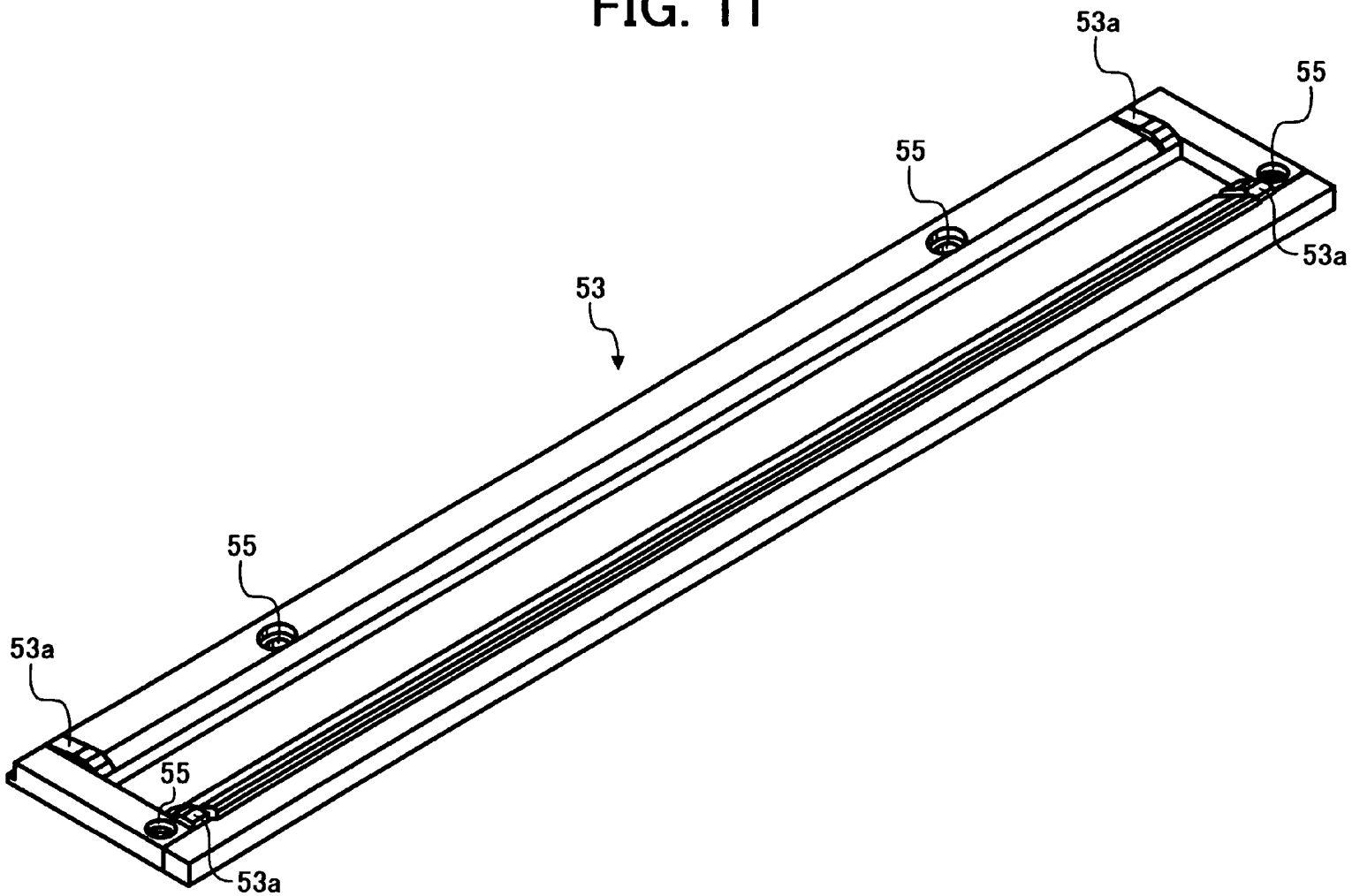
FIG. 11 is a perspective view of a guide of the image reading apparatus according to the another exemplary embodiment of the present invention.

As illustrated in FIG. 11, the guide 53 includes positioners 53*a* and screw holes 55.

The guide 53 is disposed to surround the exposure glass 42. The positioners 53*a* are disposed at both ends of the guide 53 in the direction perpendicular to the sheet conveyance direction and are configured to position the regulators 51 when the auto document feeder 32 is situated at the closed position. The screw holes 55 are used to fix the guide 53 and the exposure glass 42 to the body 31.

As illustrated in FIG. 8, the attachment 51*d* includes a material common to the regulator 51 and is disposed on a top end of one of the regulators 51 to bend toward the other regulator 51. The tab 51*e* includes a material common to the regulator 51 and is disposed on a top end of the other regulator 51 to bend toward a direction opposite to the one of the regulator 51. The attachment 51*f* is attached on the tab 51*e* by caulking.

The press 50 is attached to the auto document feeder 32 by horizontally sliding the attachment 51*d* into a predetermined position on a bottom surface of the auto document feeder 32 and vertically inserting the attachment 51*f* into another predetermined position on the bottom surface of the auto document feeder 32. A predetermined allowance is provided between the auto document feeder 32 and the press 50 attached thereto. Therefore, when the auto document feeder 32 is situated at the closed position, the press 50 is positioned at a predetermined position with respect to the guide 53 in accordance with shapes of the regulators 51 and the positioners 53*a*.

As illustrated in FIG. 10, the upstream slant 51*a* protrudes toward the guide 53 and the exposure glass 42 further than an upstream bottom surface of the press 50. The horizontal portion 51*c* protrudes toward the exposure glass 42 by about 0.2 mm to about 0.7 mm further than a horizontal bottom surface of the press 50, which is parallel to the top surface of the exposure glass 42. The downstream slant 51*b* levels with a downstream bottom surface of the press 50.

The upstream slant 51*a* and the downstream slant 51*b* slant at a common angle and the regulator 51 is formed in an axisymmetric shape with respect to a line D. Therefore, when the auto document feeder 32 is situated at the closed position, upstream and downstream portions of the regulator 51 in the sheet conveyance direction evenly contact the positioners 53*a*.

According to this non-limiting embodiment, while the regulator 51 is formed in the axisymmetric shape with respect to the line D, an upstream bottom surface of the press 50 slants at an angle sharper than that of a downstream bottom surface of the press 50. This is because the compact size image reading apparatus 30 requires an original sheet S to be conveyed from the first conveyance path 21 to the reader 10 at an angle sharper than an angle at which the original sheet S is conveyed from the reader 10 to the second conveyance path 22. According to this non-limiting embodiment, the upstream slant 51*a* protrudes toward the guide 53 and the exposure glass 42 further than the upstream bottom surface of the press 50. However, when a modified layout of the first conveyance path 21, the reader 10, and the second conveyance path 22 changes the angles at which the original sheet S is conveyed to and from the reader 10, the downstream slant 51*b* or both the upstream slant 51*a* and the downstream slant 51*b* may protrude toward the guide 53 and the exposure glass 42 further than the upstream and downstream bottom surfaces of the press 50.

According to this non-limiting embodiment, the regulators 51 are separately molded from the press 50. The regulators 51 are attached to the press 50 on the caulking portions 54 by caulking.

Figure 12:
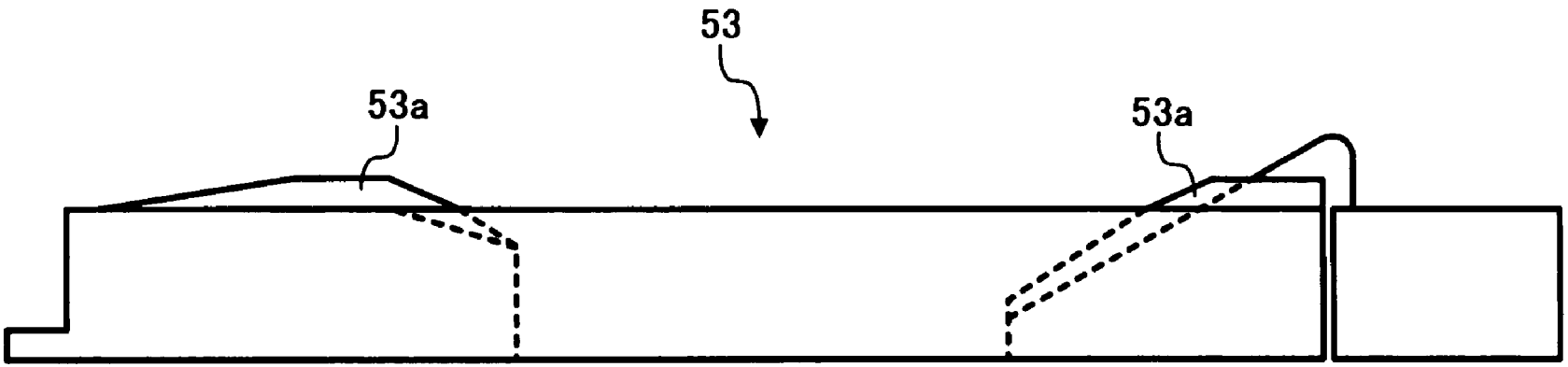
FIG. 12 is a side view of the guide shown in FIG. 11.

As illustrated in FIGS. 11 and 12, each of the positioners 53*a* is formed in a mountain-like shape having an apex protruding toward the regulator 51. Namely, the positioners 53*a* having the mountain-like shape are disposed upstream (i.e., left) and downstream (i.e., right) in the sheet conveyance direction as illustrated in FIG. 12. Thus, when the auto document feeder 32 is situated at the closed position, each of the upstream slant 51*a* and the downstream slant 51*b* contacts the apex of the positioner 53*a*.

The guide 53 is attachable and detachable to and from the body 31 as the guide 43 according to the previous non-limiting embodiment. The guide 53 includes fixing members for fixing the exposure glass 42 to the reader 10. The screw holes 55 are used as the fixing members and are provided to attach the guide 53 and the exposure glass 42 to the reader 10 of the body 31. Screws or bolts (not shown) are inserted into the screw holes 55.

The guide 53 includes two portions, i.e., an upstream portion and a downstream portion. The positioners 53*a* disposed upstream (i.e., left) in the sheet conveyance direction as illustrated in FIG. 12 are disposed in the upstream portion of the guide 53. The positioners 53*a* disposed downstream (i.e., right) in the sheet conveyance direction as illustrated in FIG. 12 are disposed in the downstream portion of the guide 53. To attach the guide 53 to the body 31, a bottom surface of the downstream portion of the guide 53 is attached to the body 31 with a double-faced adhesive tape or the like. Then, the screws or the bolts are inserted into the screw holes 55 to attach the upstream portion of the guide 53 to the body 31. An elastic material (not shown), such as a spring, may be used as a pressing member for applying a pressure downward to the regulator 51 as in the previous non-limiting embodiment.

According to this non-limiting embodiment, the upstream slant 51*a* protrudes toward the guide 53 and the exposure glass 42 further than the upstream bottom surface of the press 50. The regulator 51 can be formed in a proper shape regardless of the press 50 formed in a shape in which the upstream bottom surface of the press 50 slants at an angle sharper than that of the downstream bottom surface of the press 50. Therefore, the guide 53 and the press 50 can be properly positioned both in the vertical direction and in the sheet conveyance direction. As a result, the image reading apparatus 30 can provide improved image reading quality even for a color original sheet for which the guide 53 and the press 50 need to be positioned more accurately than for a monochrome original sheet.

According to this non-limiting embodiment, each of the upstream slant 51*a* and the downstream slant 51*b* of the regulator 51 contacts the apex of the positioner 53*a*, decreasing a friction between the regulator 51 and the positioners 53*a*. The regulator 51 smoothly moves to a proper position on each of the positioners 53*a*, and then stops at the proper position. Thus, when the auto document feeder 32 is situated at the closed position, the regulator 51 can be kept at the proper position on each of the positioners 53*a*.

According to this non-limiting embodiment, the press 50 is separately molded from the regulators 51. Shaping of the press 50 and the regulators 51 can be less restricted than when the press 50 is integrally molded with the regulators 51 by metal sheet processing. Thus, the press 50 and the regulators 51 can be flexibly shaped with improved dimensional accuracy.

According to this non-limiting embodiment, the regulators 51 are jointed with the press 50 by caulking to prevent the press 50 and the regulators 51 from being deformed by heat caused by welding or brazing. Thus, the press 50 and the regulators 51 can be shaped with improved dimensional accuracy.

FIGS. 13 to 17 illustrate the image reading apparatus 30 according to yet another exemplary embodiment of the present invention. The image reading apparatus 30 according to this non-limiting embodiment includes a presser 20*b* replacing the pressers 20 and 20*a* and a guide 63 replacing the guides 43 and 53. The other parts of the image reading apparatus 30 according to this non-limiting embodiment are common to the image reading apparatus 30 according to the preceding non-limiting embodiments.

Figure 13:
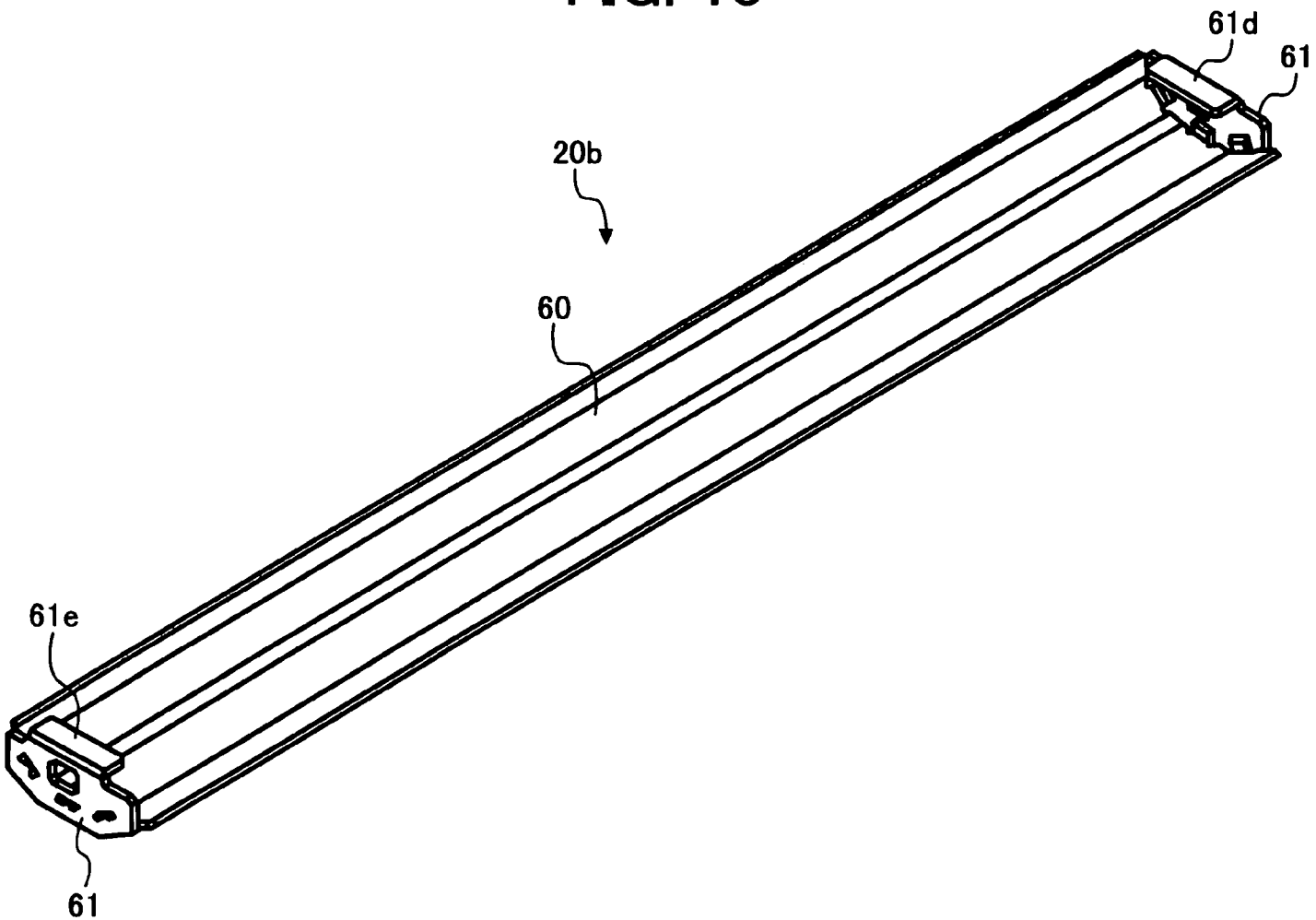
FIG. 13 is a top perspective view of a presser of an image reading apparatus according to yet another exemplary embodiment of the present invention.
Figure 14:
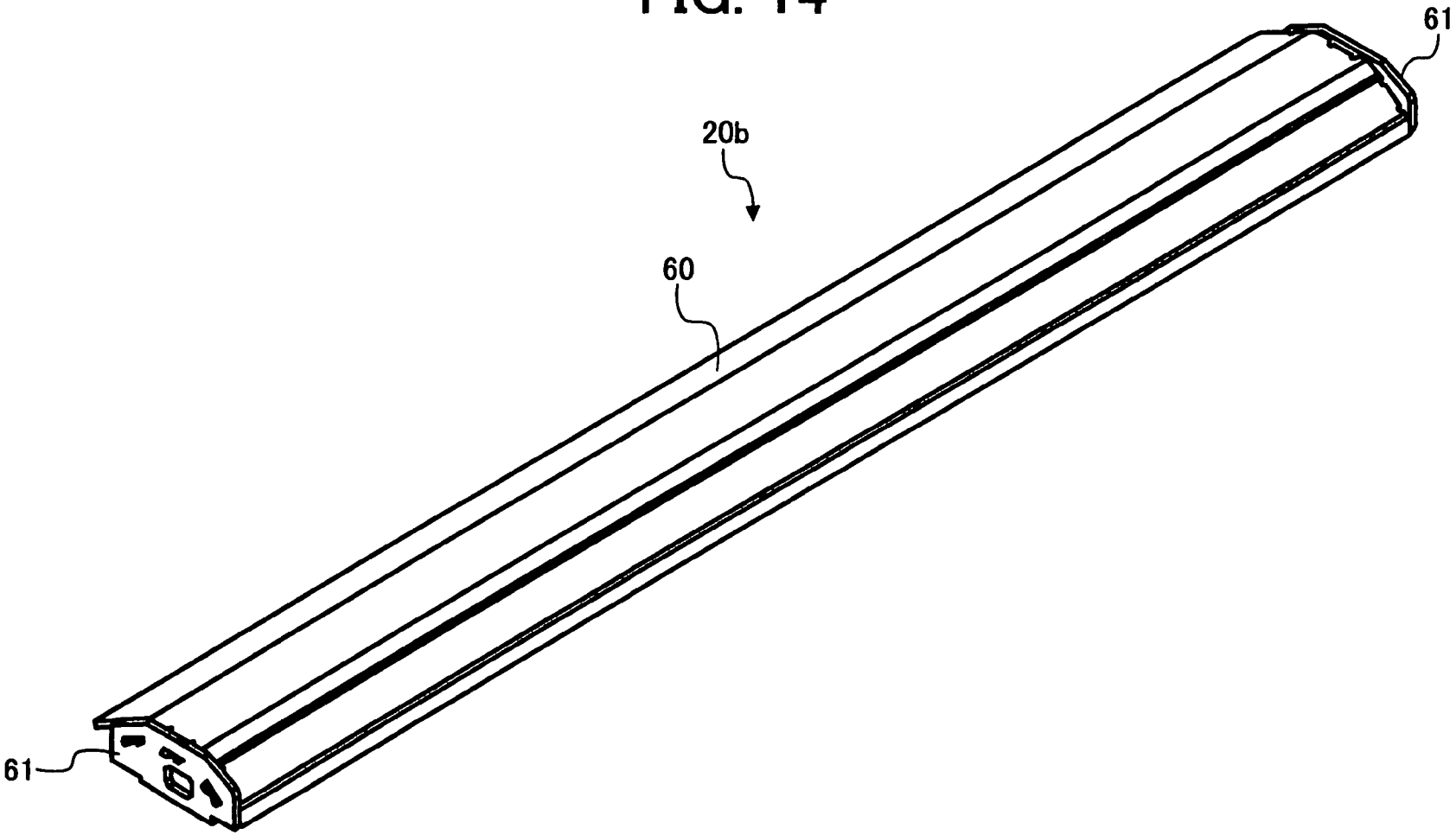
FIG. 14 is a bottom perspective view of the presser shown in FIG. 13.

As illustrated in FIGS. 13 and 14, the presser 20*b* includes a press 60 and regulators 61. The regulators 61 include attachments 61*d* and 61*e*.

The presser 20*b* is positioned with respect to the guide 63 to press an original sheet S onto the exposure glass 42. The press 60 is configured to press the original sheet S onto the exposure glass 42. The regulators 61 are disposed at both ends of the press 60 in the direction perpendicular to the sheet conveyance direction and are configured to position the press 60 with respect to the guide 63. The attachment 61*d* is disposed on one of the regulators 61 and is configured to slide in the horizontal direction to attach the regulator 61 to the auto document feeder 32. The attachment 61*e* is disposed on the other regulator 61 and is configured to slide in the horizontal direction to attach the regulator 61 to the auto document feeder 32.

Figure 15:
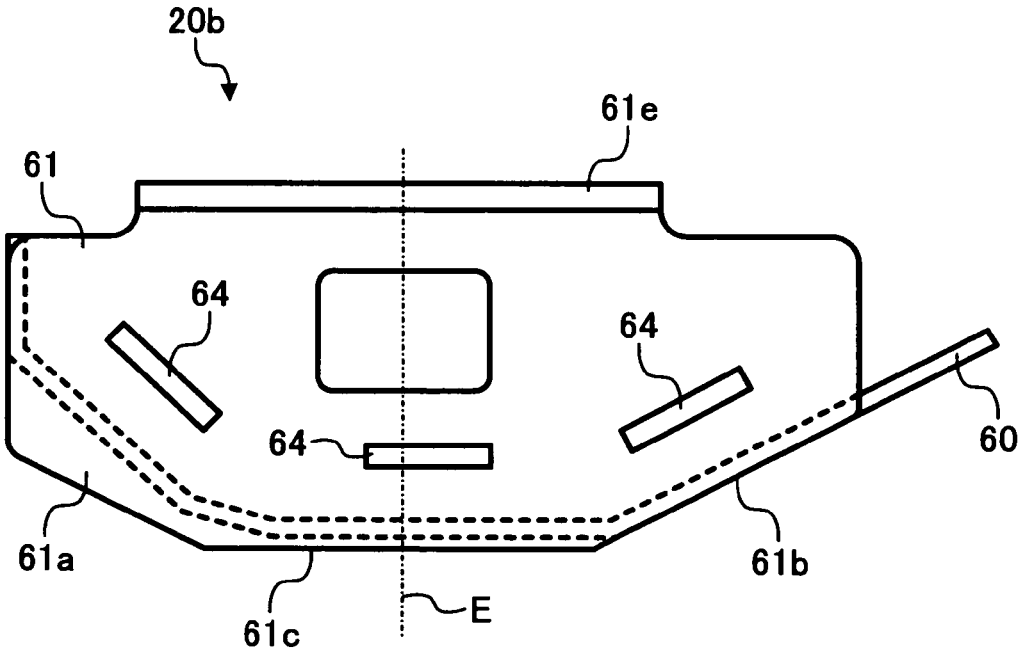
FIG. 15 is a side view of the presser shown in FIG. 13.

As illustrated in FIG. 15, the regulator 61 further includes a horizontal portion 61*c*, an upstream slant 61*a*, a downstream slant 61*b*, and caulking portions 64.

The horizontal portion 61*c* is disposed parallel to the top surface of the exposure glass 42 and a bottom surface of the press 60. The upstream slant 61*a* is disposed upstream (i.e., left) in the sheet conveyance direction. The downstream slant 61*b* is disposed downstream (i.e., right) in the sheet conveyance direction. The caulking portions 64 are positions where the regulator 61 is jointed with the press 60 by caulking.

Figure 16:
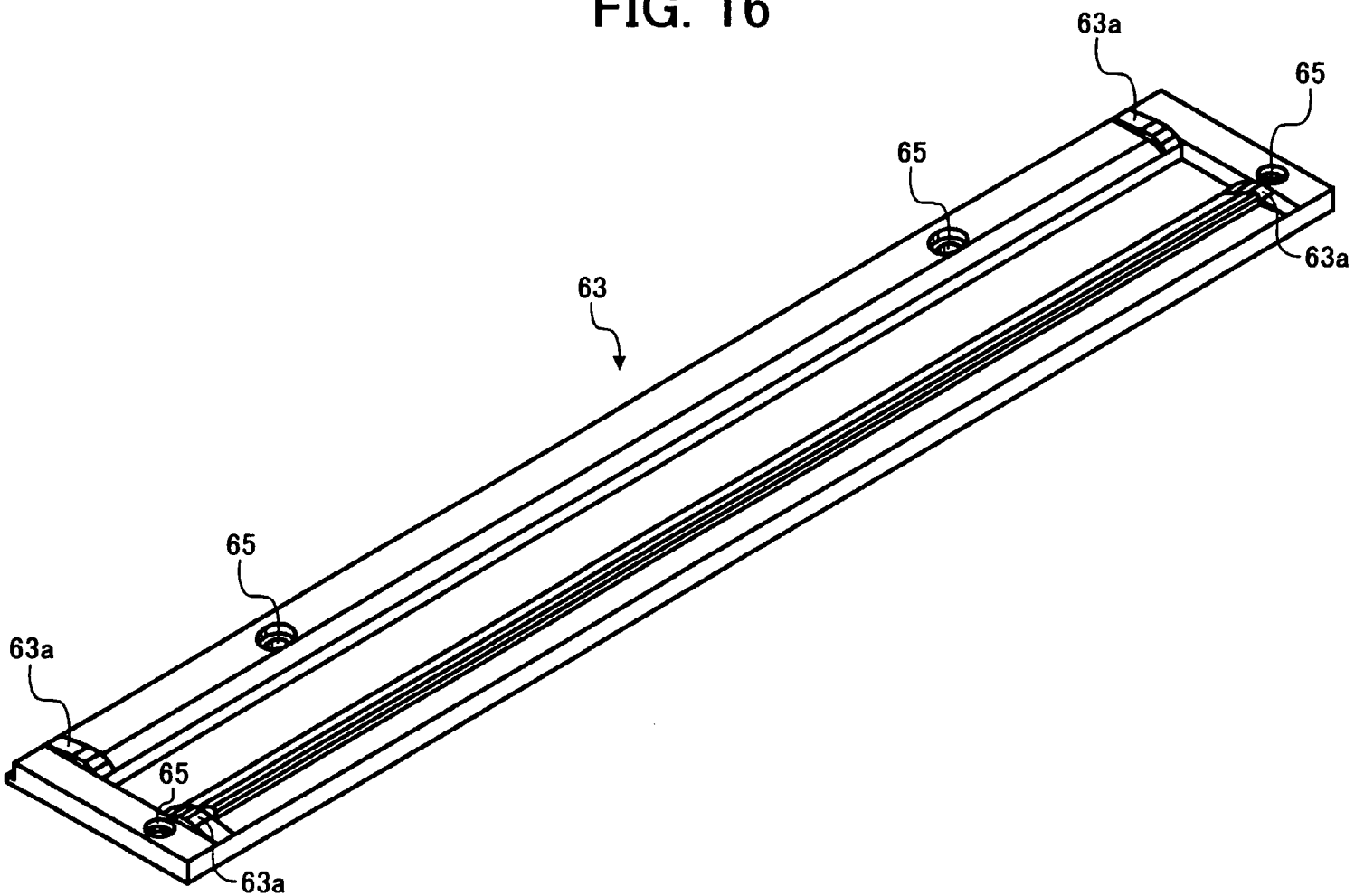
FIG. 16 is a perspective view of a guide of the image reading apparatus according to the yet another exemplary embodiment of the present invention.

As illustrated in FIG. 16, the guide 63 includes positioners 63*a* and screw holes 65.

The guide 63 is disposed to surround the exposure glass 42. The positioners 63*a* are disposed at both ends of the guide 63 in the direction perpendicular to the sheet conveyance direction and are configured to position the regulators 61 when the auto document feeder 32 is situated at the closed position. The screw holes 65 are used to attach the guide 63 and the exposure glass 42 to the body 31.

As illustrated in FIG. 13, the attachments 61*d* and 61*e* include a material common to the regulators 61. The attachment 61*d* is disposed on a top end of one of the regulators 61 and is formed by sheet metal processing to bend toward the other regulator 61. The attachment 61*e* is disposed on a top end of the other regulator 61 and is formed by sheet metal processing to bend toward the one of the regulator 61.

The press 60 is attached to the auto document feeder 32 by horizontally sliding the attachments 61*d* and 61*e* into predetermined positions on the bottom surface of the auto document feeder 32. A predetermined allowance is provided between the auto document feeder 32 and the press 60 attached thereto. Therefore, when the auto document feeder 32 is situated at the closed position, the press 60 is positioned at a predetermined position with respect to the guide 63 in accordance with shapes of the regulators 61 and the positioners 63*a*.

As illustrated in FIG. 15, the upstream slant 61*a* protrudes toward the guide 63 and the exposure glass 42 further than an upstream bottom surface of the press 60. The horizontal portion 61*c* protrudes toward the exposure glass 42 by about 0.2 mm to about 0.7 mm further than a horizontal bottom surface of the press 60, which is parallel to the top surface of the exposure glass 42. The downstream slant 61*b* levels with a downstream bottom surface of the press 60.

The upstream slant 61*a* and the downstream slant 61*b* slant at a common angle and the regulator 61 is formed in an axisymmetric shape with respect to a line E. Therefore, when the auto document feeder 32 is situated at the closed position, upstream and downstream portions of the regulator 61 in the sheet conveyance direction evenly contact the positioners 63*a*.

According to this non-limiting embodiment, while the regulator 61 is formed in the axisymmetric shape with respect to the line E, the upstream bottom surface of the press 60 slants at an angle sharper than that of the downstream bottom surface of the press 60. This is because the compact size image reading apparatus 30 requires an original sheet S to be conveyed from the first conveyance path 21 to the reader 10 at an angle sharper than an angle at which the original sheet S is conveyed from the reader 10 to the second conveyance path 22. According to this non-limiting embodiment, the upstream slant 61*a* protrudes toward the guide 63 and the exposure glass 42 further than the upstream bottom surface of the press 60. However, when a modified layout of the first conveyance path 21, the reader 10, and the second conveyance path 22 changes the angles at which the original sheet S is conveyed to and from the reader 10, the downstream slant 61*b* or both the upstream slant 61*a* and the downstream slant 61*b* may protrude toward the guide 63 and the exposure glass 42 further than the upstream and downstream bottom surfaces of the press 60.

According to this non-limiting embodiment, the regulators 61 are separately molded from the press 60. The regulators 61 are attached to the press 60 on the caulking portions 64 by caulking.

Figure 17:
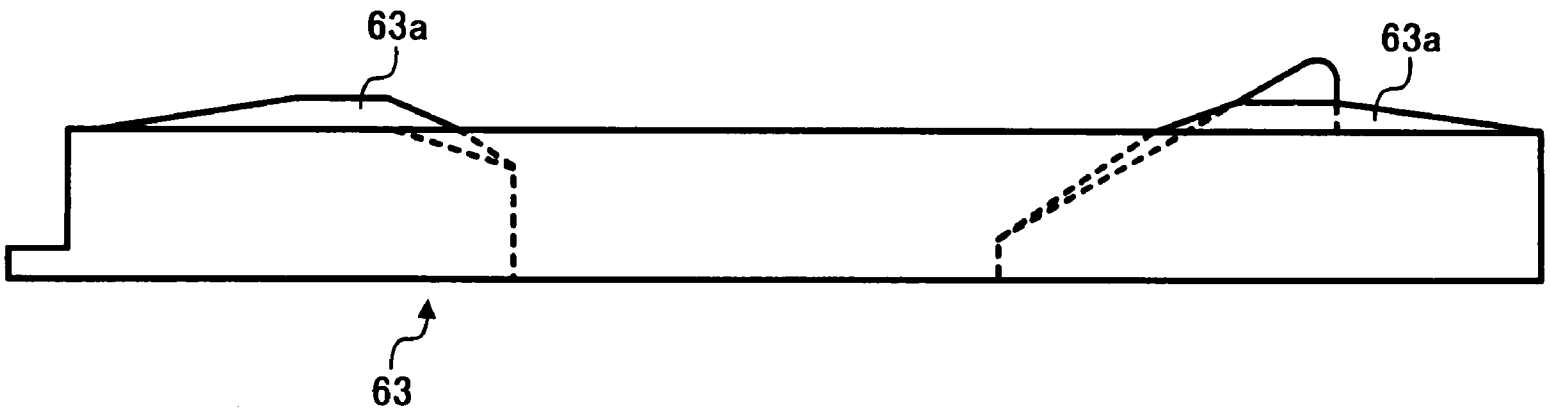
FIG. 17 is a side view of the guide shown in FIG. 16.

As illustrated in FIGS. 16 and 17, each of the positioners 63*a* is formed in a mountain-like shape having an apex protruding toward the regulator 61. Namely, the positioners 63*a* having the mountain-like shape are disposed upstream (i.e., left) and downstream (i.e., right) in the sheet conveyance direction as illustrated in FIG. 17. Thus, when the auto document feeder 32 is situated at the closed position, each of the upstream slant 61*a* and the downstream slant 61*b* contacts the apex of the positioner 63*a*. A friction between the regulator 61 and the positioner 63*a* decreases when the regulator 61 contacts the apex of the positioner 63*a* instead of a surface of the positioner 63*a*. The regulator 61 smoothly moves to a proper position on each of the positioners 63*a*, and then stops at the proper position. Thus, when the auto document feeder 32 is situated at the closed position, the regulator 61 can be kept at the proper position on each of the positioners 63*a*.

The guide 63 is attachable and detachable to and from the body 31 similarly as the guides 43 and 53 according to the preceding non-limiting embodiments. The guide 63 includes fixing members for fixing the exposure glass 42 to the reader 10. The screw holes 65 are used as the fixing members and are provided to attach the guide 63 and the exposure glass 42 to the reader 10 of the body 31. Screws or bolts (not shown) are inserted into the screw holes 65. According to this non-limiting embodiment, the guide 63 includes a single portion unlike the guide 53 including the upstream portion and the downstream portion. Thus, a clearance between the two positioners 63*a* disposed upstream and downstream in the sheet conveyance direction on the guide 63 is kept unchanged. An elastic material (not shown), such as a spring, may be used as a pressing member for applying a pressure downward to the regulator 61, such as the spring 46 according to the previous non-limiting embodiment.

According to this non-limiting embodiment, the upstream slant 61*a* protrudes toward the guide 63 and the exposure glass 42 further than the upstream bottom surface of the press 60. The regulator 61 can be formed in a proper shape regardless of the press 60 formed in a shape in which the upstream bottom surface of the press 60 slants at an angle sharper than that of the downstream bottom surface of the press 60. Therefore, the guide 63 and the press 60 can be properly positioned both in the vertical direction and in the sheet conveyance direction. As a result, the image reading apparatus 30 can provide improved image reading quality even for a color original sheet for which the guide 63 and the press 60 need to be positioned more accurately than for a monochrome original sheet.

According to this non-limiting embodiment, each of the upstream slant 61*a* and the downstream slant 61*b* of the regulator 61 contacts the apex of the positioner 63*a*, decreasing a friction between the regulator 61 and the positioners 63*a*. The regulator 61 smoothly moves to a proper position on each of the positioners 63*a*, and then stops at the proper position. Thus, when the auto document feeder 32 is situated at the closed position, the regulator 61 can be kept at the proper position on each of the positioners 63*a*.

According to this non-limiting embodiment, the press 60 is separately molded from the regulators 61. Shaping of the press 60 and the regulators 61 can be less restricted than when the press 60 is integrally molded with the regulators 61 by metal sheet processing. Thus, the press 60 and the regulators 61 can be flexibly shaped with improved dimensional accuracy.

According to this non-limiting embodiment, the regulators 61 are jointed with the press 60 by caulking to prevent the press 60 and the regulators 61 from being deformed by heat caused by welding or brazing. Thus, the press 60 and the regulators 61 can be shaped with improved dimensional accuracy.

The image reading apparatus 30 according to the above-described non-limiting embodiments can provide improved image reading quality with the structure in which the auto document feeder 32 can be lifted and lowered from and onto the body 31.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

The invention claimed is:

1. An image reading apparatus, comprising:

a body including, an exposure glass, a reader configured to read an image of an original sheet through the exposure glass, and a guide disposed on the exposure glass and configured to support the original sheet, the guide including first and second positioners disposed in upstream and downstream ends of a sheet conveyance direction; and an auto document feeder configured to be swingably moved between an open position and a closed position relative to the body and to feed the original sheet onto the exposure glass when situated at the closed position, the auto document feeder including, a press configured to press the original sheet onto the exposure glass, and a regulator mounted to the press and including first and second slanted portions respectively, and configured to contact the respective first and second positioners of the guide at the first and second slanted ends in the upstream and downstream ends of the sheet conveyance direction when the auto document feeder is situated at the closed position so as to form a slit between the exposure glass and the press, the slit allowing the original sheet to pass therethrough.

2. The image reading apparatus according to claim 1, wherein the regulator regulates a clearance between the press and the exposure glass when the auto document feeder is situated at the closed position.

3. The image reading apparatus according to claim 1, wherein the positioners have a shape corresponding to a shape of the regulator and configured to contact the regulator.

4. The image reading apparatus according to claim 1, wherein the regulator has a symmetrical shape in upstream and downstream sides in a conveyance direction of the original sheet.

5. The image reading apparatus according to claim 1, wherein each of the slanted portions contacts an apex of the positioner.

6. The image reading apparatus according to claim 1, further comprising:

a pressing member configured to apply a pressure downward to the press.

7. The image reading apparatus according to claim 1, wherein the guide includes a fixing member configured to fix the exposure glass to the body.

8. The image reading apparatus according to claim 1, wherein the regulator is integrally molded with the press.

9. The image reading apparatus according to claim 1, wherein the regulator is separately molded from the press.

10. The image reading apparatus according to claim 9, wherein the regulator is jointed with the press by caulking.

11. The image reading apparatus according to claim 6, wherein the pressing member includes a spring.

12. An image reading apparatus, comprising:

a body including, an exposure glass, a reader configured to read an image of an original sheet through the exposure glass, and means for guiding disposed on the exposure glass and for supporting the original sheet, and including a first and second means for positioning disposed in upstream and downstream ends of a sheet conveyance direction; and an auto document feeder configured to be swingably moved between an open position and a closed position relative to the body and to feed the original sheet onto the exposure glass when situated at the closed position, the auto document feeder including, means for pressing the original sheet onto the exposure glass, and means for contacting the means for guiding, including first and second slanted portions respectively disposed in upstream and downstream ends of a sheet conveyance direction, to contact the first and second means for positioning at both of the first and second slanted portions in the upstream and downstream ends of the sheet conveyance direction when the auto document feeder is situated at the closed position so as to form a slit between the exposure glass and the means for pressing, the slit allowing the original sheet to pass therethrough, the means for contacting being mounted to the means for pressing.

13. The image reading apparatus according to claim 12, further comprising:

means for applying a pressure downward to the means for pressing.

* * * * *